US006276358B1

(12) United States Patent
Brin, Jr. et al.

(10) Patent No.: US 6,276,358 B1
(45) Date of Patent: Aug. 21, 2001

(54) VERTICALLY ADJUSTABLE VENTILATION HOOD SYSTEM FOR A COOKING APPLIANCE

(75) Inventors: George G. Brin, Jr., Providence; Luke Michas, North Providence; Marc S. Harrison, deceased, late of Portmouth, by Diana Harrison, executrix; Michael T. Lye, Warwick, all of RI (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/440,125

(22) Filed: Nov. 15, 1999

(51) Int. Cl.[7] ..... F24C 15/20

(52) U.S. Cl. ..... 126/299 D; 108/50.13; 108/50.18; 108/106

(58) Field of Search ..... 126/299 D, 299 R; 454/63; 108/17, 20, 50.13, 50.18, 106, 147.19

(56) References Cited

U.S. PATENT DOCUMENTS

| | | | |
|---|---|---|---|
| 3,011,492 | 12/1961 | Humbert . | |
| 3,064,551 | 11/1962 | Stalker . | |
| 3,356,008 | 12/1967 | Simpson et al. . | |
| 3,409,005 | 11/1968 | Field . | |
| 3,443,802 | 5/1969 | Werner . | |
| 3,496,704 | 2/1970 | Bandlow . | |
| 4,446,849 | 5/1984 | McFarland . | |
| 4,596,060 | 6/1986 | Schmidt et al. . | |
| 4,650,171 | 3/1987 | Howorth . | |
| 4,934,337 | 6/1990 | Falk . | |
| 5,062,410 * | 11/1991 | Sarnosky et al. | 126/299 D |
| 5,231,972 | 8/1993 | Galassi . | |
| 5,427,570 | 6/1995 | Chen . | |
| 5,577,490 | 11/1996 | Overton, Jr. . | |
| 5,690,093 | 11/1997 | Schrank et al. . | |

FOREIGN PATENT DOCUMENTS

| | | | |
|---|---|---|---|
| 3503236 * | 8/1986 | (DE) | 126/299 D |
| 60-30916 * | 2/1985 | (JP) | 126/299 D |
| 63-131931 * | 6/1988 | (JP) | 126/299 D |
| 1-114649 * | 5/1989 | (JP) | 126/299 D |
| 5-231689 * | 9/1993 | (JP) | 126/299 D |

* cited by examiner

*Primary Examiner*—Sara Clarke
(74) *Attorney, Agent, or Firm*—Everett G. Diederiks, Jr.

(57) ABSTRACT

A ventilation system for a cooking appliance includes one or more slidable vent hoods arranged in a tabletop extending above a heating surface of a cooking appliance to exhaust gaseous byproduct developed during a cooking operation performed on the heating surface. The tabletop is vertically adjustable relative to the heating surface in order to alter the distance between each vent hood and the heating surface. Each vent hood can be retracted within the tabletop or extended to a position disposed directly, vertically above at least a portion of the heating surface. Preferably, a pair of adjacent vent hoods are provided, with each vent hood opening into a common exhaust manifold formed in the tabletop. The tabletop is preferably mounted through multiple pillars which are connected to a vertical adjusting mechanism. One of the pillars is preferably provided with an elongated duct for directing exhaust gases from the manifold to a remote exhaust location.

19 Claims, 3 Drawing Sheets

VERTICALLY ADJUSTABLE VENTILATION HOOD SYSTEM FOR A COOKING APPLIANCE

BACKGROUND OF THE INVENTION

1. Field of the Invention

The present invention pertains to the art of cooking appliances and, more particularly, to an appliance ventilation system incorporating a vertically adjustable vent hood arrangement.

2. Discussion of the Prior Art

Many different types of cooking appliances produce smoke, steam or other gaseous byproducts during use. Often, it is considered beneficial to utilize some type of ventilation system to evacuate the gaseous byproducts, either upwards through a venting hood or downward into a draught flue. In typical household kitchens, most known venting arrangements take the form of a hood which is fixed above a cooking surface and which can be selectively activated to evacuate the gaseous byproducts. Downdraft vent arrangements are also widely known in the art wherein a cooking surface will incorporate a vent opening that is positioned between different sections of the cooking surface or extends along a back of the cooking surface. These downdraft vents can either be fixed relative to the cooking surface or can be raised slightly relative to the cooking surface to an in-use position.

With known vent hood arrangements, a vertical distance between the cooking surface and the vent hood is fixed. At least when in an operating position, downdraft vent arrangements known in the art are also limited in this respect. Depending upon the food being cooked and even the particular height of the individual doing the cooking, it may be desired to vary the distance between the cooking surface and the vent hood. For instance, when frying fish on a cooking surface, it may be considered beneficial to arrange a vent hood vertically closer to the cooking surface in order to increase the percentage of gaseous byproducts which are evacuated. On the other hand, it may be desired to raise a vent hood relative to a cooking surface in order to more easily access different portions of the cooking surface.

In any event, there is considered a need in the art for an improved ventilation system for use with a cooking appliance. More particularly, there is a need in the art for a ventilation system incorporating a vent hood which can be selectively, vertically adjusted relative to a heating surface.

SUMMARY OF THE INVENTION

The present invention pertains to a ventilation system for a cooking appliance having a heating surface. More specifically, the ventilation system incorporates at least one vent hood which is integrated into a vertically adjustable support that is position ed above the cooking appliance. Preferably, the vent hood is movable between an extended, in-use position wherein it projects at least partially over a portion of the heating surface, and a retracted, non-use position wherein the vent hood is recessed in the support. In the most preferred form of the invention, a pair of adjacent vent hoods are arranged above respective sections of the heating surface and are slidable between the extended and retracted positions.

In one preferred form of the invention, the cooking appliance constitutes a cooktop disposed in a countertop of a cooking island. Arranged above the countertop is an additional tabletop that is supported by a pair of spaced, upstanding pillars. The pillars are movable relative to a base of the countertop, such as through the use of hydraulic, pneumatic or electric actuators, to vertically shift the tabletop relative to the countertop. Within a body of a tabletop is formed a common plenum or manifold for the individual vent hoods, with the manifold leading to an exhaust duct extending through one of the pillars and into the countertop base.

With this arrangement, the height at which one or more vent hoods are arranged above the heating surface of the cooking appliance can be selectively altered by adjusting the height of the tabletop. The use of multiple vent hood sections enables each of the vent hoods to be dedicated for use in connection with individual sections of the heating surface, while minimizing an potential obstruction for the cook. In any event, additional objects, features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
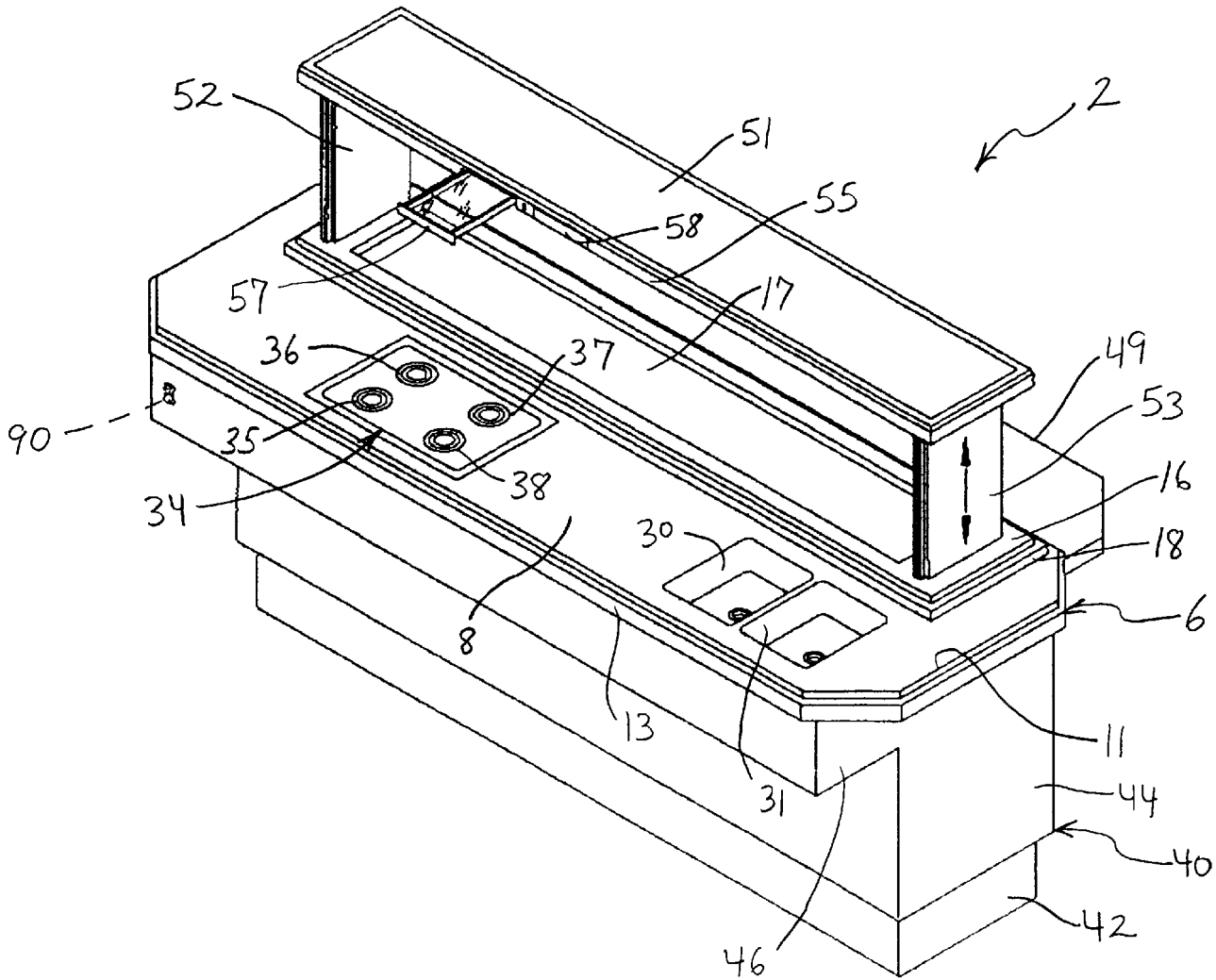
FIG. 1 is an upper prospective view of a kitchen island incorporating the appliance ventilation system of the present invention.

With initial reference to FIG. 1, a workstation for a cooking environment that is generally illustrated to take the form of a kitchen island is indicated at 2. Island 2 includes an overall countertop 6 having a work surface 8 that is preferably provided with a peripheral lip 11. Also located around first work surface 8, at a position slightly outwardly and below lip 11, is railing trim 13. As shown, countertop 6 also includes a raised platform 16 having a central zone 17 and an associated, intermediate tier 18. In the embodiment shown, island 2 is provided with a pair of spaced sinks 30 and 31, as well as a cooking appliance shown in the form of an electric cooktop 34. For the sake of simplicity of the drawings, a faucet for sinks 30 and 31, as well as controls for cooktop 34 have not been illustrated. However, cooktop 34 is shown to include multiple, spaced heating elements 35–38. Although the structure and arrangement of cooktop 34 is not considered part of the present invention, cooktop 34 preferably defines a substantially smooth working surface across countertop 6.

Countertop 6 is shown to be supported by a base 40 having a lowermost section 42 and an upper section 44 that includes an outwardly extending portion 46. Therefore, upper section 44, with outwardly extending portion 46, supports countertop 6 such that first work surface 8 extends in a substantially horizontal plane. At this point, it should be noted that outwardly extending portion 46 need not extend entirely across the longitudinal side of countertop 6 but could simply be constituted by various spaced, cantilevered beams if enhanced leg room or the like is desirable under countertop 6. In any event, upper section 44 of base 40 is further used to support a table 49 that is adapted to be used in connection with chairs or the like as a small breakfast or other eating area while the portion of countertop 6 located on the opposite side of platform 16 from table 49 would generally be located in the kitchen area. Again, this arrangement is merely presented in accordance with the preferred embodiment of the invention and for the sake of completeness.

Figure 2:
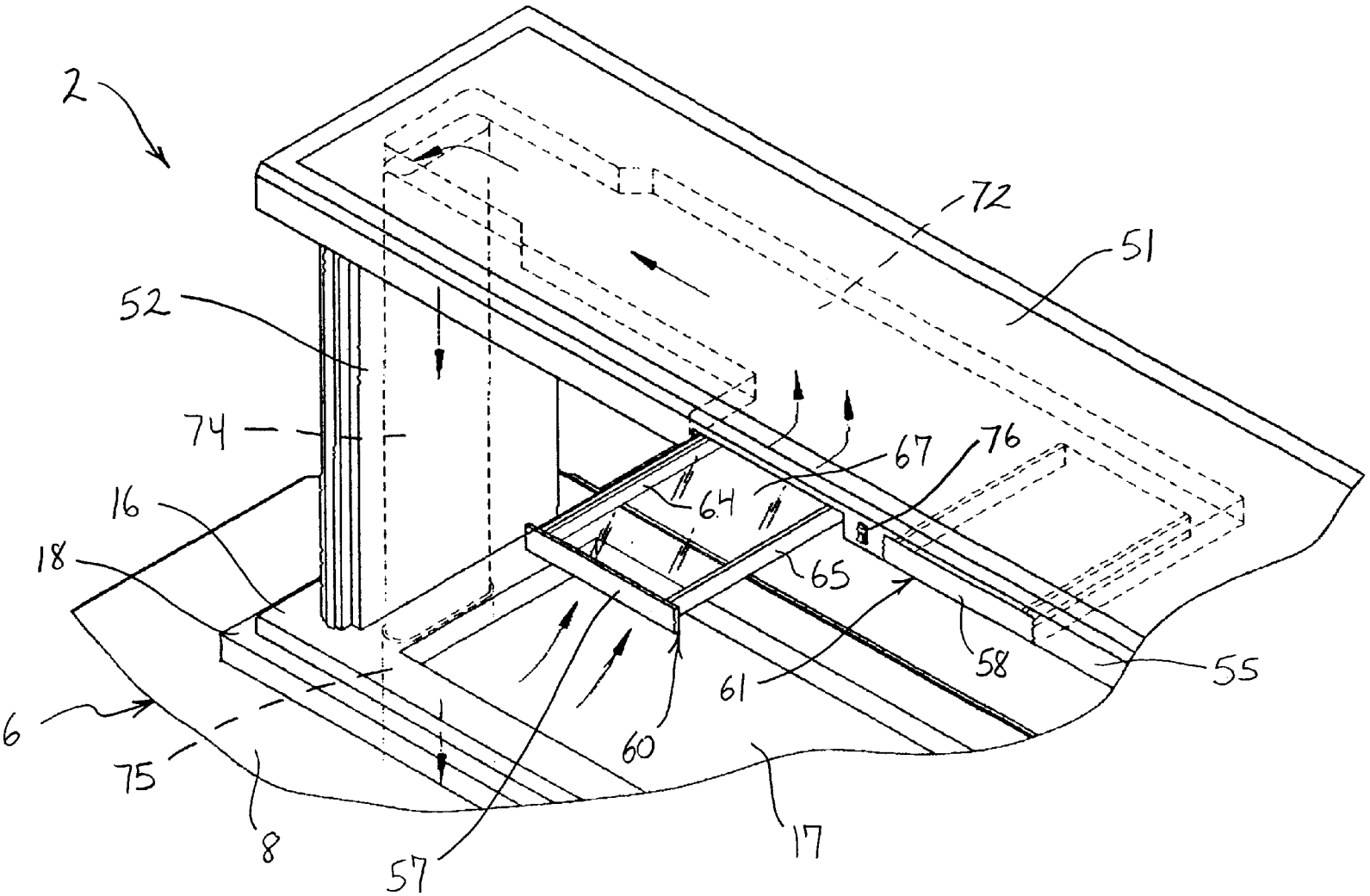
FIG. 2 is an enlarged, partially phantom view of a section of the ventilation system of FIG. 1.

Island 2 is shown to include an upper support unit in the form of a tabletop 51 that is spaced above platform 16 by means of pillars 52 and 53. As shown with reference to both FIGS. 1 and 2, tabletop 51 includes an annular face portion 55, a portion of which is defined by front panels 57 and 58 of respective vent hoods 60 and 61 which form part of the ventilation system of the present invention. As each vent hood 60, 61 is similarly constructed, the discussion of the preferred construction and arrangement of vent hoods 60 and 61 will be made simultaneously. Each vent hood 60, 61 includes side frame members 64 and 65 which extend from a respective front panel 57, 58 and which are slidably supported by tabletop 51. Extending across side frame members 64 and 65 is an upper plate 67. In the most preferred embodiment, plate 67 is defined by a transparent, tempered glass panel.

Each vent hood 60, 61 is slidably mounted for movement between extended and retracted positions above cooktop 34. In general, vent hoods 60 and 61 are slidably mounted in a manner analogous to convention drawers for movement between extended and retracted positions. More specifically, vent hood 61 is shown in a retracted position wherein front panel 58 is generally flush with and constitutes an extension of face portion 55 of tabletop 51. On the other hand, vent hood 60 is shown in an extended position wherein side frame members 64 and 65 project outwardly from face portion 55 of tabletop 51 and at least a portion of transparent plate 67 is positioned at a spaced distance directly above cooktop 34. More specifically, when in the extended position, vent hood 60 preferably extends above heating units 35 and 36, while vent hood 61 is adapted to extend above heating units 37 and 38. With this arrangement, each vent hood 60, 61 is generally dedicated for use with individual sections of cooktop 34.

Since transparent plate 67 only extends across an upper portion of side frame members 64 and 65, a lower intake zone (not separately labeled) is defined beneath each of the vent hoods 60, 61. This intake zone leads into a common exhaust manifold 72 formed within tabletop 51. Common exhaust manifold 72 leads to a first exhaust duct 74 that extends downward within pillar 52. First exhaust duct 74 is preferably, slidably received within a second, slightly larger diametric exhaust duct 75 which extends into base 40. Although not shown, base 40 preferably houses an exhaust blower which draws air and other gaseous byproducts into vent hoods 60 and 61, exhaust manifold 72, first exhaust duct 74 and second exhaust duct 75. The blower would also have an associated outlet duct leading through a floor below base 40 in order to vent the gaseous byproducts to the ambient environment in a manner generally known in the art. In accordance with the most preferred embodiment, the blower and ventilation system of the present invention can be activated through the use of a switch, such as that shown at 76 between vent hoods 60 and 61. If desired, vent hoods 60 and 61 and/or tabletop 51 can also be provided with lighting (not shown).

Figure 3:
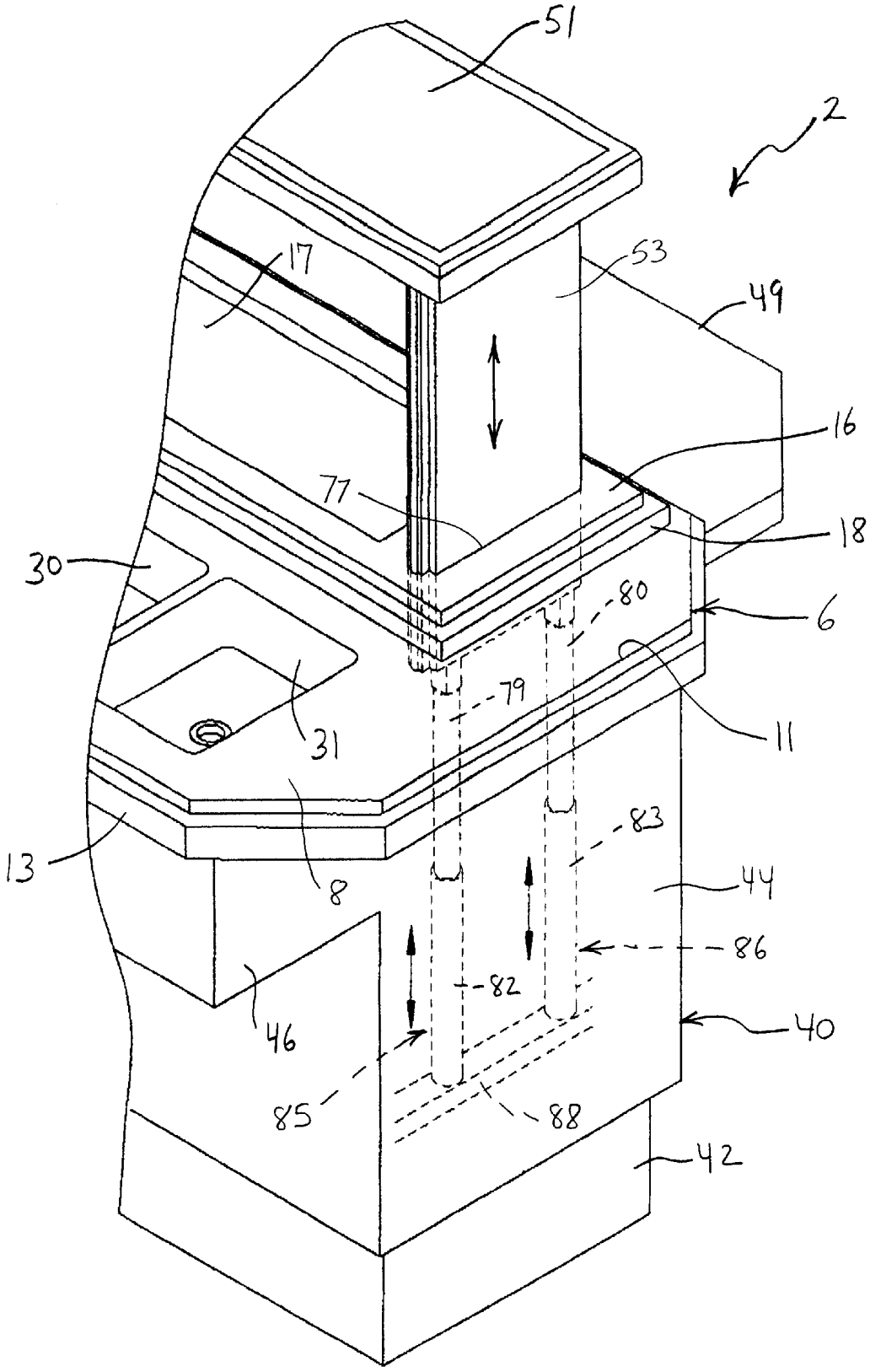
FIG. 3 is an enlarged view of an end portion of the island of FIG. 1 showing a vertical adjustment mechanism incorporated in accordance with the invention in phantom.

In accordance with the present invention, tabletop 51 is intended to vertically shift relative to countertop 6 in order to vary the distance between cooktop 34 and each vent hood 60, 61. In the most preferred form of the invention, pillars 52 and 53 are supported by the remainder of countertop 6 for relative vertical movement. More specifically, as shown with reference to FIG. 3, pillar 53 projects through an elongated opening 77 formed in platform 16, tier 18 and work surface 8 of countertop 6. A lower portion of pillar 53 is supported by one or more pistons 79, 80. Each piston 79, 80 is received within a respective cylinder 82,83. Therefore, pistons 79 and 80 and cylinders 82 and 83 combine to define respective linear actuators 85 and 86. Cylinders 82 and 83 are shown to be fixed to a cross piece 88 that is secured within base 40. In the most preferred embodiment of the invention, hydraulic fluid is utilized in connection with one or more actuators 85 and 86 for each pillar 52 and 53. As indicated in FIG. 1, a toggle switch 90 is preferably provided as part of the overall base 40 for use in connection with selectively raising or lowering tabletop 51 relative to work surface 8 of countertop 6. Although hydraulic actuators are utilized in accordance with the preferred embodiment, it should be readily apparent that other types of vertical adjustment mechanisms known in the art could be equally employed. For example, pneumatic, electric and the like type mechanisms could be utilized.

With this construction, tabletop 51 can be raised and lowered relative to work surface 8 from a position generally directly above platform 16 to a fully raised position corresponding to that illustrated in FIG. 1. Since vent hoods 60 and 61 are carried by tabletop 51, the raising and lowering of tabletop 51 commensurately raises and lowers vent hoods 60 and 61. In accordance with the ventilation system of the present invention, this ability to raise and lower vent hoods 60 and 61 is considered to advantageously enhance the exhausting of gaseous byproducts which can be produced when utilizing cooktop 34. In addition, a distance between the heating surface defined by cooktop 34 and each vent hood 60, 61 can be altered to simply accommodate different sized cooks. Furthermore, due to the manner in which vent hoods 60 and 61 can be slid between extended and retracted positions, the ventilation system of the invention can be utilized with one or more of the vent hood 60 and 61 in a partially extended position. Although it would be possible to provide a single vent hood extending over all of heating units 35–38, it is preferable to provide individual vent hoods 60 and 61 in order to limit any unnecessary, upper obstructions.

Although described with reference to a preferred embodiment of the invention, it should be readily apparent that various changes and/or modifications can be made to the invention without departing from the spirit thereof. For instance, although ducts 74 and 75 are preferably provided for exhausting the gaseous byproducts while accommodating is the vertical shifting of tabletop 51, other exhaust configurations, such as a flexible bellows-type ducting arrangement, could also be utilized. In any event, the invention is only intended to be limited by the scope of the following claims.

What is claimed is:

1. A combination cooking and ventilation system comprising:

a heating surface;

a support unit positioned above the heating surface;

at least one vent hood carried by the support unit at a position spaced a distance above the heating surface, with the vent hood being adapted to project directly over at least a portion of the heating surface;

a mechanism for selectively, vertically shifting the support unit relative to the heating surface, thereby adjusting the distance between the heating surface and the vent hood, wherein the vent hood is moveable between extended and retacted positions, wherein the vent hood projects directly over the portion of the heating surface in only the extended position.

2. The combination cooking ventilation system according to claim 1, wherein the vent hood is slidably mounted to the support unit for movement between the extended and retracted positions.

3. The combination cooking ventilation system according to claim 2, wherein the support unit is constituted by a tabletop, said vent hood being recessed in a portion of the tabletop when in the retracted position.

4. The combination cooking ventilation system according to claim 1, wherein the support unit is constituted by a tabletop and wherein the at least one vent hood comprises a pair of adjacent vent hoods adapted to extend over different portions of the heating surface.

5. The combination cooking ventilation system according to claim 1, wherein the support unit is formed with a manifold into which the vent hood opens.

6. The combination cooking ventilation system according to claim 5, wherein the tabletop is positioned above the heating surface through at least a pair of vertical supports, said ventilation system further including an exhaust duct leading from the manifold through at least one of the supports.

7. The combination cooking and ventilation system according to claim 6, further comprising, in combination, a kitchen island having a countertop, said heating surface being disposed on the countertop, said vertical supports constituting pillars. which extend through the countertop, said mechanism being connected to said pillars.

8. A combination cooking and ventilation system comprising:

a countertop;

a heating surface disposed along a portion of the countertop;

an upper tabletop extending across at least the portion of the countertop, said tabletop being vertically adjustable relative to the countertop; and at least one vent hood carried by and movable relative to the tabletop at a position spaced a distance above the heating surface, with the vent hood being adapted to project directly over at least a portion of the heating surface, said vent hood being vertically shiftable in unison with the tabletop to alter the distance between the heating surface and the vent hood.

9. The combination cooking ventilation system according to claim 8, wherein the vent hood is moveable between extended and retracted positions, wherein the vent hood projects directly over the portion of the heating surface in only the extended position.

10. The combination cooking ventilation system according to claim 9, wherein the vent hood is slidably mounted to the tabletop for movement between the extended and retracted positions.

11. The combination cooking ventilation system according to claim 10, wherein said vent hood is recessed in a portion of the tabletop when in the retracted position.

12. The combination cooking ventilation system according to claim 9, wherein the at least one vent hood comprises a pair of adjacent vent hoods adapted to extend over different portions of the heating surface.

13. The combination cooking and ventilation system according to claim 12, wherein the tabletop is formed with a manifold into which the vent hoods open.

14. The combination cooking ventilation system according to claim 13, wherein the tabletop is positioned above the heating surface through at least a pair of vertical supports, said ventilation system further including an exhaust duct leading from the manifold through at least one of the supports.

15. The combination cooking and ventilation system according to claim 8, further comprising, in combination, a kitchen island, wherein the countertop, cooking appliance, tabletop and vent hood form parts of the kitchen island.

16. A method of ventilating a cooking appliance having a heating surface arranged below an upper support unit comprising:

re-positioning a vent hood from a non-use position, wherein the vent hood is supported by the support unit in a retracted condition, to and in-use position, wherein the vent hood projects from the support directly over at least a portion of the heating surface; and altering a vertical distance between the heating surface and the vent hood by selectively, vertically adjusting the support unit relative to the heating surface.

17. The method according to claim 16, further comprising: sliding the vent hood between the non-use and in-use positions.

18. The method according to claim 17, further comprising: shifting an additional vent hood from a retracted position to an extended position over a second portion of the heating surface.

19. The method according to claim 17, further comprising: exhausting gaseous byproducts, produced during a cooking operation on the heating surface, through the vent hood, an exhaust manifold formed in the support unit and a duct extending along at least one vertically shiftable pillar through which the support unit is mounted.

* * * * *